US011657748B2

(12) United States Patent
Lu

(10) Patent No.: US 11,657,748 B2
(45) Date of Patent: May 23, 2023

(54) DISPLAY CONTROL METHOD AND DISPLAY DEVICE

(71) Applicant: Lenovo (Beijing) Limited, Beijing (CN)

(72) Inventor: Zhengliu Lu, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 17/551,688

(22) Filed: Dec. 15, 2021

(65) Prior Publication Data

US 2022/0309977 A1 Sep. 29, 2022

(30) Foreign Application Priority Data

Mar. 26, 2021 (CN) ..... 202110330654.0

(51) Int. Cl.
*G09G 3/20* (2006.01)

(52) U.S. Cl.
CPC ..... *G09G 3/20* (2013.01); *G09G 2310/0281* (2013.01); *G09G 2330/021* (2013.01); *G09G 2340/0435* (2013.01)

(58) Field of Classification Search
None
See application file for complete search history.

(56) References Cited

U.S. PATENT DOCUMENTS

2009/0109159 A1* 4/2009 Tsai ..... G09G 3/3611 345/98
2012/0249605 A1* 10/2012 Kim ..... G09G 3/3666 345/87
2015/0287352 A1* 10/2015 Watanabe ..... G09G 3/3648 345/89
2015/0302792 A1* 10/2015 Lu ..... G09G 3/32 315/294
2016/0042708 A1* 2/2016 Wang ..... G09G 3/3611 345/214
2016/0232831 A1* 8/2016 Nakanishi ..... G09G 3/3648
2019/0043435 A1* 2/2019 Yang ..... G09G 3/3406
2019/0266965 A1* 8/2019 Kawashima ..... G09G 3/20
2021/0035488 A1* 2/2021 Seo ..... G09G 3/2092
2022/0189408 A1* 6/2022 Jo ..... G09G 3/3233

FOREIGN PATENT DOCUMENTS

CN 111933038 A 11/2020
CN 112309301 A 2/2021

OTHER PUBLICATIONS

Flicker definition downloaded on Aug. 26, 2022 from https://www.thefreedictionary.com/flicker, pp. 1-6 (Year: 2022).*

* cited by examiner

*Primary Examiner* — Dorothy Harris
(74) *Attorney, Agent, or Firm* — Anova Law Group, PLLC

(57) ABSTRACT

A display control method includes: in response to a display area of a display device being divided into multiple display sub-areas, controlling outputs from the multiple display sub-areas at corresponding refresh rates. The refresh rates of different display sub-areas can be the same or different.

16 Claims, 12 Drawing Sheets

DISPLAY CONTROL METHOD AND DISPLAY DEVICE

CROSS-REFERENCE TO RELATED APPLICATION

This application claims priorities to Chinese Patent Application No. 202110330654.0 filed on Mar. 26, 2021, the entire content of which is incorporated herein by reference.

TECHNICAL FIELD

The present disclosure relates to the technical field of computer technologies and, more particularly, to a display control method and a display device.

BACKGROUND

With development of computer technologies, high refresh rate display screens have been more and more widely adopted. However, refreshing a full screen at a high refresh rate may cause a display screen to consume more power.

SUMMARY

One aspect of the present disclosure provides a display control method. The method includes: in response to a display area of a display device being divided into multiple display sub-areas, controlling outputs from the multiple display sub-areas at corresponding refresh rates. The refresh rates of different display sub-areas are the same or different.

Another aspect of the present disclosure provides a display device. The device includes: a display component having a display area, and multiple control components. Each control component corresponds to the display area of the display device, and each control component includes a circuit for driving each pixel in the display area. In response to the display area of the display device being divided into multiple display sub-areas, an output from each display sub-area is controlled by a corresponding control component at a refresh rate of the corresponding display sub-area through the circuit for driving each pixel in the corresponding display sub-area, wherein the refresh rate supported by the control component corresponding to each display sub-area is related to the refresh rate of the corresponding display sub-area.

BRIEF DESCRIPTION OF THE DRAWINGS

To more clearly illustrate the technical solution of the present disclosure, the accompanying drawings used in the description of the disclosed embodiments are briefly described below. The drawings described below are merely some embodiments of the present disclosure. Other drawings may be derived from such drawings by a person with ordinary skill in the art without creative efforts and may be encompassed in the present disclosure.

DETAILED DESCRIPTION OF THE EMBODIMENTS

Embodiments of the present disclosure are described in detail below with reference to the accompanying drawings. It will be appreciated that the described embodiments are some rather than all of the embodiments of the present disclosure. Other embodiments obtained by those having ordinary skills in the art on the basis of the described embodiments without inventive efforts should fall within the scope of the present disclosure.

Figure 1:
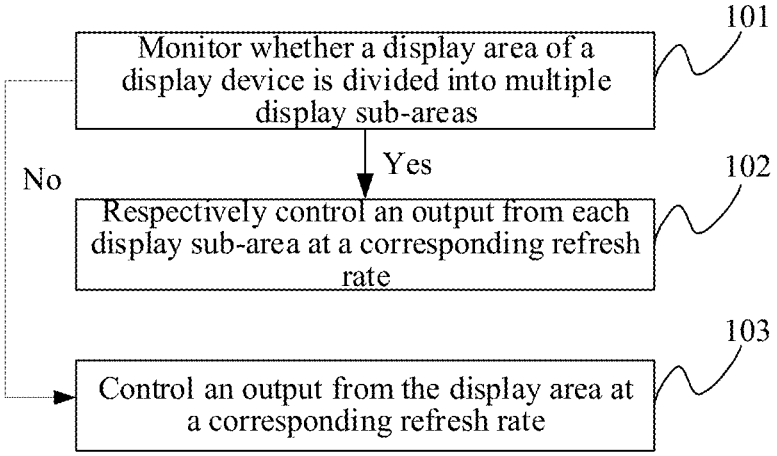
FIG. 1 is a flowchart illustrating an exemplary display control method according to some embodiments of the present disclosure.

FIG. 1 is a flowchart illustrating an exemplary display control method according to some embodiments of the present disclosure. The method can be applied to a display device having a display area, such as a display screen or a mobile phone display screen. The embodiments of the present disclosure are intended to solve a technical problem of high power consumption of the display screen caused by a full screen high refresh rate.

Specifically, the method of the present disclosure may include the following steps.

At step 101, whether a display area of a display device is divided into a plurality of display sub-areas is monitored. When the display area of the display device is detected to be divided into a plurality of display sub-areas, step 102 is executed. When the display area of the display device is not detected to be divided into a plurality of display sub-areas, step 103 is executed.

In other words, in some embodiments, whether the display area of the display device is divided into the plurality of display sub-areas is detected. When the display area of the display device is detected to be divided into the plurality of display sub-areas, an output control method at step 102 is performed. When the display area of the display device is not detected to be divided into the plurality of display sub-areas, an output control method step 103 is performed.

Figure 2:
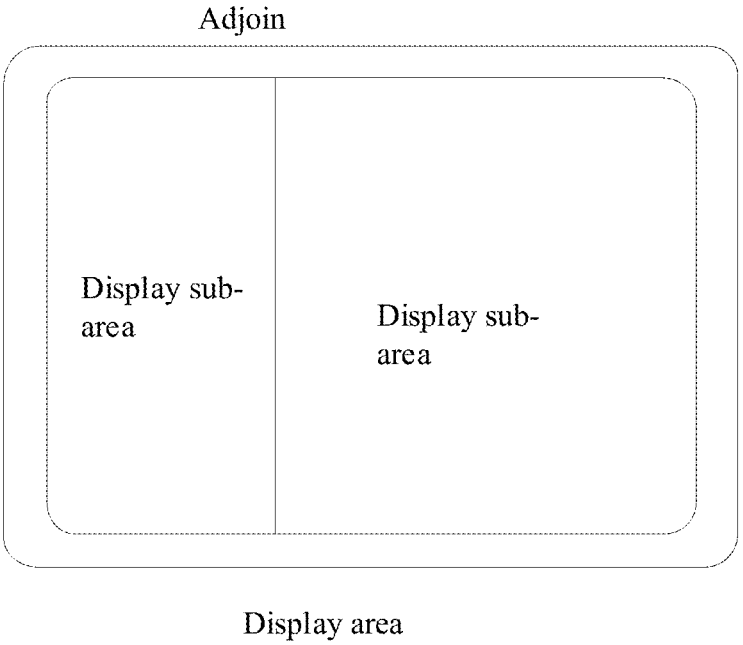
FIGS. 2-8 are schematic diagrams illustrating exemplary application scenarios according to some embodiments of the present disclosure.
Figure 3:
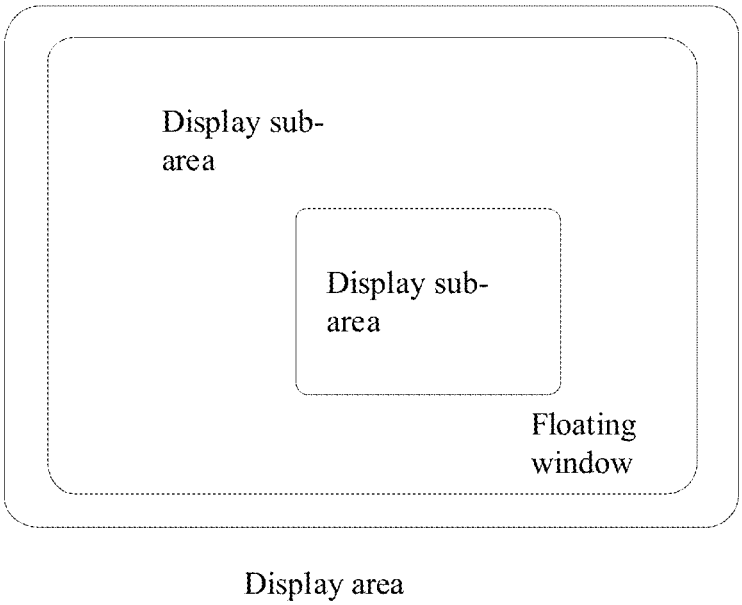

In some embodiments, divided displaying refers to dividing the display area into the plurality of display sub-areas and displaying in each of the plurality of display sub-areas. As shown in FIG. 2, after the display device receives a display division operation, the display area is divided into two or three display sub-areas. The display sub-areas may be adjacent to each other, but are not overlapping with each other. The display sub-areas jointly form the display area. In some other embodiments, the divided displaying also refers to cutting out a small window from the display area, overlaying the small window on the display area, and displaying contents in both the small window and the underlying display area (i.e., another display sub-area). In some embodiments, as shown in FIG. 3, after the display device receives an overlaying window displaying operation, one or more small windows are overlayed on the display area. The one or more small windows may be dialog boxes or application display windows. The display sub-areas where the one or more small windows are located overlap with the display area, and block a portion of contents displayed on the display area.

In some embodiments, whether the display device receives the divided display operation, the overlaying window displaying operation, or both is monitored, to determine whether the display area needs to be divided into a plurality of display sub-areas.

At step 102, an output from each display sub-area is controlled according to a corresponding refresh rate. Different display sub-areas have an identical refresh or different refresh rates.

Figure 4:
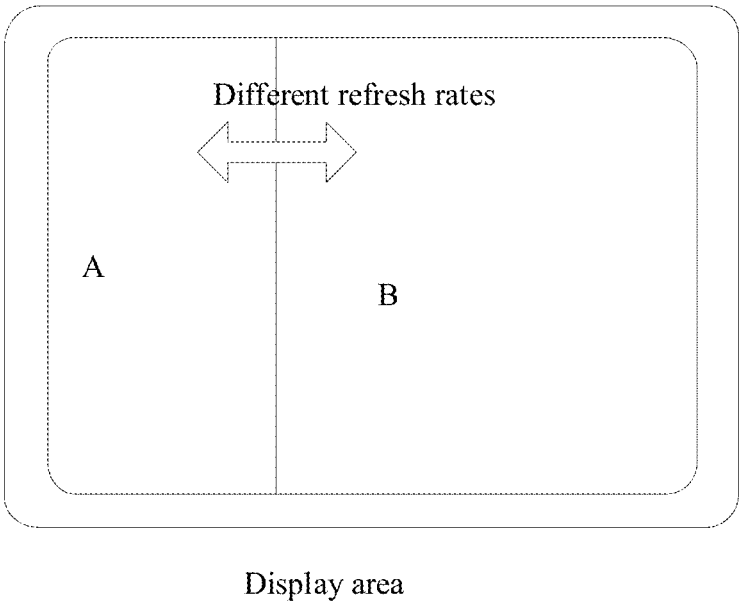
Figure 5:
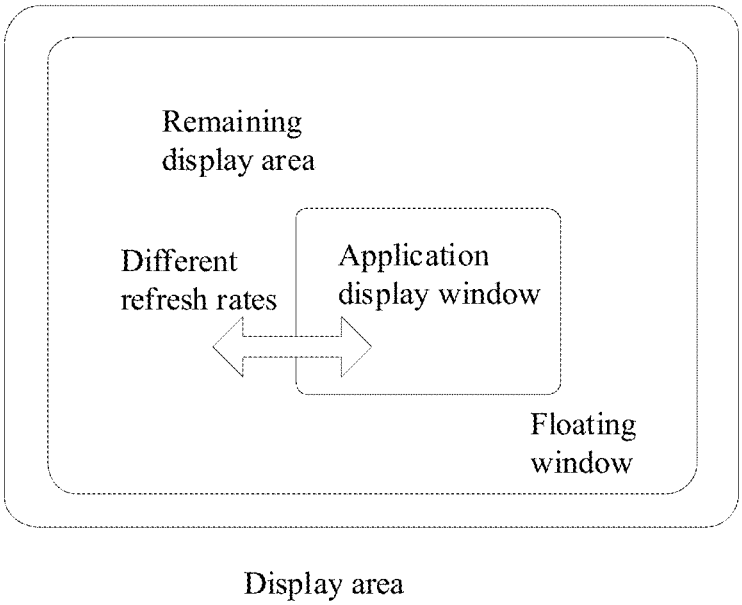

As shown in FIG. 4, the display area is divided into a display sub-area A on the left and a display sub-area B on the right. A refresh rate of the display sub-area A is different from a refresh rate of the display sub-area B. As shown in FIG. 5, an application display window is overlayed on the display area. A refresh rate of the application display window is different from a refresh rate of the rest of the display area. As such, the output from each display sub-area is controlled according to the corresponding refresh rate. It is not necessary to apply a high refresh rate for the entire display area.

At step 103, an output from the display area is controlled according to a corresponding refresh rate.

For example, the output from the display area is controlled according to a low refresh rate or a high refresh rate.

In the display control method provided by the embodiments of the present disclosure, whether the display area is divided into a plurality of display sub-areas is monitored, and the output from each display sub-area is controlled according to a corresponding refresh rate. Thus, a high power consumption caused by keeping a high refresh rate for the entire display area can be avoided, thereby reducing the power consumption of the display device.

Further, in some embodiments, controlling the output from each display sub-area at the corresponding refresh rate provides a user with various viewing methods. For example, the user may view contents displayed in different display sub-areas at different refresh rates. In another example, the user may view contents displayed in different display sub-areas at a same refresh rate. Thus, user's experience of viewing the display device is enriched.

In one embodiment, the refresh rate of each display sub-area is related to a configuration operation received for the corresponding display sub-area. In this case, the configuration operation is a configuration operation performed by the user of the display device for the corresponding display sub-area.

The configuration operation includes a refresh parameter, such that the refresh rate of the display sub-area corresponds to the refresh parameter.

In some embodiments, a configuration interface is provided to the user. The configuration interface may be prompted to the user after the user starts to operate the display device. For example, when the display device is powered on for the first time or each time thereafter, the user is prompted with the configuration interface. In some embodiments, the configuration interface may be prompted to the user after the display area of the display device is divided into a plurality of display sub-areas. For example, after the display area of the display deice is divided into a display sub-area A and a display sub-area B, the configuration interface is prompted to the user, such that the user is able to configure the refresh parameters for the display sub-areas A and B of this screen division display, respectively. In some embodiments, when necessary, the user may trigger the prompt of the configuration interface to configure the refresh rate. For example, the user may use a physical button or a touch-control button to trigger the prompt of the configuration interface in the display area, such that the user may configure the refresh parameters of the two display sub-areas for this screen division display or the refresh parameters of multiple display sub-areas for subsequent screen division display. As such, the configuration interface may include multiple configuration controls including configuration controls for configuring the refresh rates. Through the configuration controls of the configuration interface for configuring the refresh rates, the user may configure the refresh rates corresponding to the display sub-areas.

Figure 6:
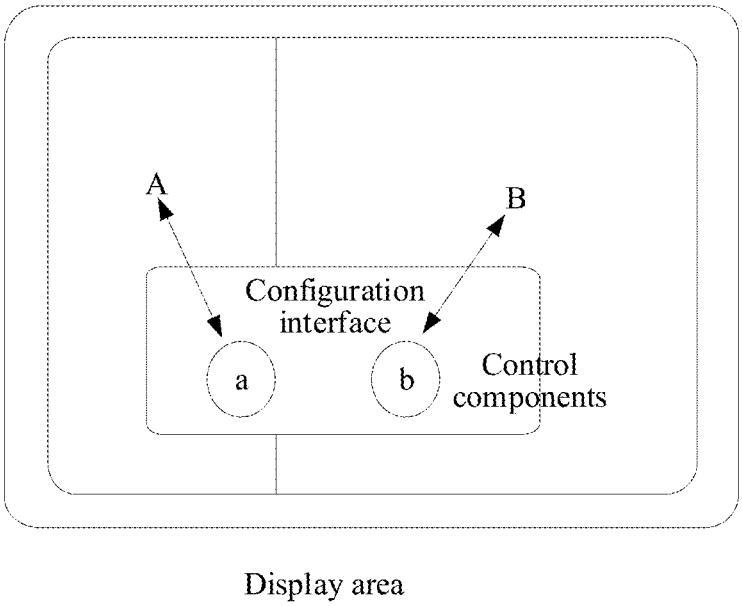

It should be noted that the configuration controls of the configuration interface for configuring the refresh parameters may one-to-one correspond to the display sub-areas divided from the display area. As shown in FIG. 6, the display area is divided into two display sub-areas A and B. The configuration interface includes the configuration controls a and b corresponding to the display sub-areas A and B, such that the user may separately configure the refresh rate for each of the two display sub-areas.

In some embodiments, after the user configures the refresh rate for each display sub-area, the display device correspondingly receives the configuration operation. The configuration operation includes the refresh rates configured by the user. Thus, the output from each display sub-area is controlled at the refresh rate corresponding to the refresh parameter of the display sub-area in the configuration operation.

In one embodiment, the refresh rate of the display sub-area is related to content displayed in the display sub-area. In other words, the refresh rate of the display sub-area may change due to a change of the content displayed in the display sub-area.

The displayed content includes a content type, such that the refresh rate of the display sub-area corresponds to the content type.

In some embodiments, the content type of the displayed content may be an output type of image frames, such as video or image. The content type may correspond to a high refresh rate, such as 90 Hz, 120 Hz, or 144 Hz, to increase an output resolution of the display sub-area, thereby providing the user with a high-resolution image frame output effect. In some other embodiments, the content type of the displayed content may be an interactive content type, such as chatting text, which corresponds to a low refresh rate, such as 60 Hz, thereby reducing the power consumption of the display device.

Figure 7:
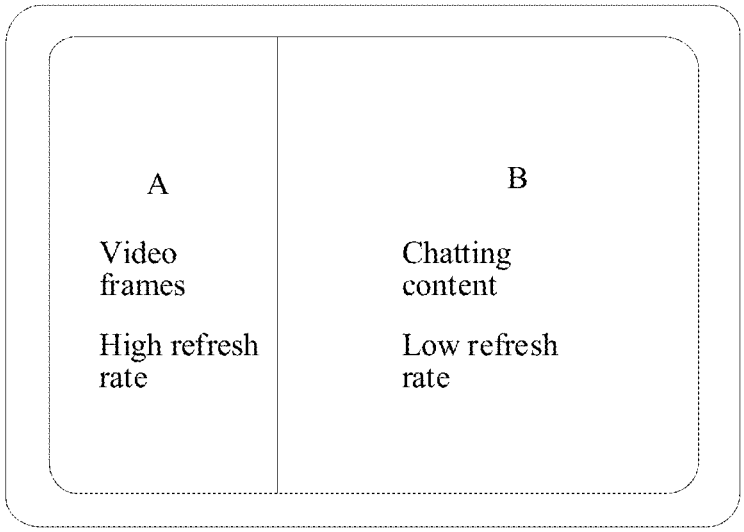

In the embodiments of the present disclosure, the display device controls the output from the display sub-area at the refresh rate corresponding to the content type of the content displayed in the display sub-area. As shown in FIG. 7, in a mobile phone capable of the screen division display, the output from the display sub-area A is controlled at a high refresh rate for displaying a video content, and the output from the display sub-area B is controlled at a low refresh rate for displaying a chatting content. Thus, the display device provides the user with an experience of viewing a high-resolution video while minimizing the power consumption of the mobile phone.

In one embodiment, the refresh rate of the display sub-area is related to display brightness of the display sub-area. The display brightness of the display sub-area may be related to scene brightness of a surrounding environment where the display device is located. For example, when the scene brightness is low, the display brightness of the display sub-area is lowered accordingly. When the scene brightness is high, the display brightness of the display sub-area is increased accordingly. In other words, the display brightness of the display device changes as ambient brightness changes. As such, the refresh rate of each display sub-area is adjusted according to changed display brightness of the display device, and the output from each display sub-area is controlled according to adjusted refresh rate of each display sub-area. Thus, the refresh rate of the display sub-area changes as the display brightness of the display sub-area changes, thereby providing the user a richer and more comfortable viewing experience.

In some embodiments, when the display brightness is lower than or equal to a brightness threshold and the refresh rate of the display sub-area is high, e.g., 120 Hz, the display sub-area exhibits unevenness due to low brightness and insufficient charging time. Thus, the refresh rate of the display sub-area configured at the display device is configured to be smaller than or equal to a refresh rate threshold. The output from the display sub-area is controlled at a refresh rate that is smaller than the refresh rate threshold. The unevenness in the display sub-area caused by a high refresh rate is suppressed and is not perceptible to the user. The user's experience of viewing the display sub-area is improved.

Figure 8:
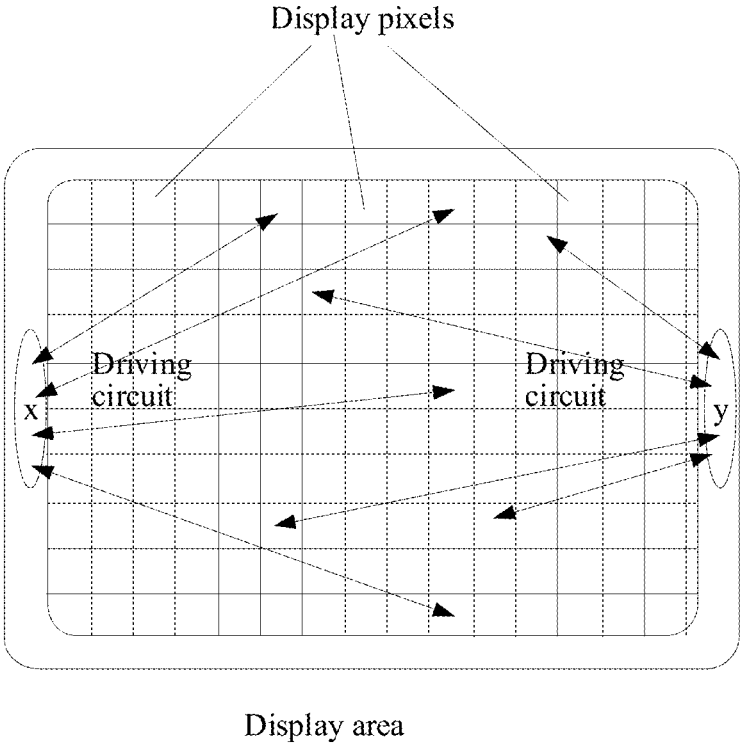

In one embodiment, the display device includes multiple control components. Each control component corresponds to the display area of the display device. Each control component includes a circuit for driving each pixel in the display area. Each control component may independently control the output from the entire display area or the output from any portion of the display area. As shown in FIG. 8, a control component x and a control component y are disposed at the display device. The control component x includes a circuit for driving each pixel in the display area. The control component y also includes a circuit for driving each pixel in the display area. As such, the control component x may independently control the output from the entire display are at the corresponding refresh rate. The control component x may also independently control the output from the entire display area at the corresponding refresh rate. The control component x may only control the output from a display sub-area A of the display area at the corresponding refresh rate. The control component y may only control the output from a display sub-area B of the display area at the corresponding refresh rate. Which control component controls the output from the display area, which control component controls the output from which display sub-area, and the refresh rate used by the corresponding control component to control the output may be adaptively adjusted according to actual needs and performance of the corresponding control component.

The performance of the control component can be construed as the refresh rate that can be supported by the control component. For example, the control component x can support a refresh rate up to 120 Hz. The control component y can support a refresh rate up to 60 Hz.

Figure 9:
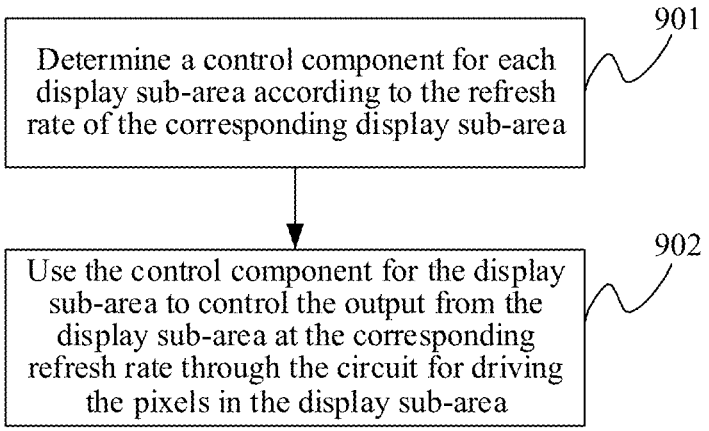
FIG. 9 is a flowchart illustrating a part of an exemplary display control method according to some embodiments of the present disclosure.

In some embodiments, at step 102, controlling the output from the display sub-area at the corresponding refresh rate includes the following steps. As shown in FIG. 9, at step 901, a control component is determined for each display sub-area according to the refresh rate of the corresponding display sub-area.

The refresh rate supported by the control component corresponding to each display sub-area is related to the refresh rate of the corresponding display sub-area.

Figure 10:
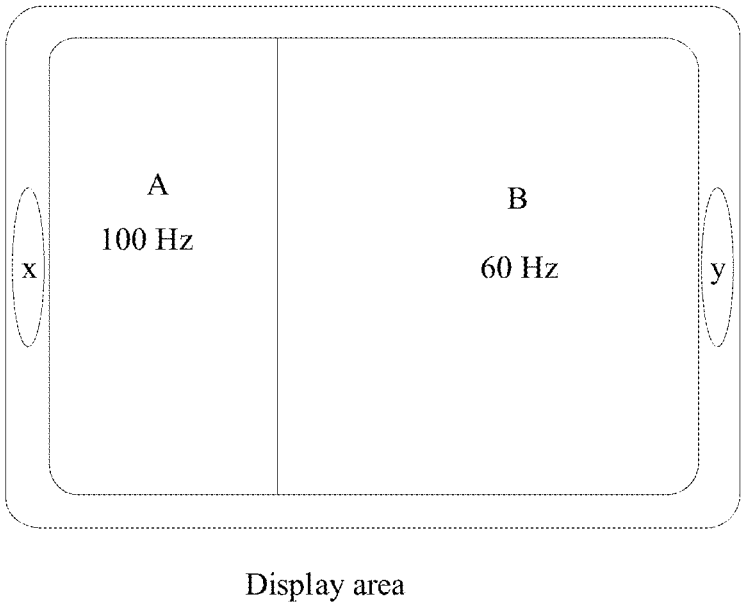
FIG. 10 is a schematic diagram illustrating another exemplary application scenario according to some embodiments of the present disclosure.

In other words, the control component that supports the refresh rate required by the display sub-area is determined based on the refresh rate required by the display sub-area. For example, as shown in FIG. 10, the display sub-area A requires the 100 Hz refresh rate, and the control component x is determined to be the control component for the display sub-area A. The display sub-area B requires the 60 Hz refresh rate, and the control component y is determined to be the control component for the display sub-area B.

At step 902, the control component corresponding to the display sub-area is used to control the output from the display sub-area at the corresponding refresh rate through the circuit for driving pixels in the corresponding display sub-area.

In some embodiments, each control component may be implemented by an independent control integrated circuit (IC) chip. In some other embodiments, each control component may be implemented by each of multiple control cores in the control IC chip. In this case, the control IC chip may be a display driver IC chip. Because the control component includes the circuit for driving each pixel, after the display sub-area controlled by the control component is determined, the control component may be used to control the output from the display sub-area at the corresponding refresh rate through the circuit for driving the pixels in the display sub-area. The control component x is used to control the output from the display sub-area A at the 100 Hz refresh rate through the circuit for driving the pixels in the display sub-area A, such that the refresh rate of the display sub-area A reaches 100 Hz to satisfy user's need for viewing the display sub-area A. The control component y is used to control the output from the display sub-area B at the 60 Hz refresh rate through the circuit for driving the pixels in the display sub-area B, such that the refresh rate of the display sub-area B reaches 60 Hz to satisfy user's need for viewing the display sub-area B. Thus, the power consumption of the display device is reduced.

In other words, the display device includes the control components that can independently control the entire screen. After the display area is divided into multiple display sub-areas, each control component controls the output from the corresponding display sub-area through the circuit for driving the pixels in the corresponding display sub-area. When the display area is undivided to output contents, any one of the control components may be used to control the output from the entire display area through a driving circuit thereof.

In some embodiments, a number of the display sub-area divided from the display area is a positive integer, for example, 2 or more.

Figure 11:
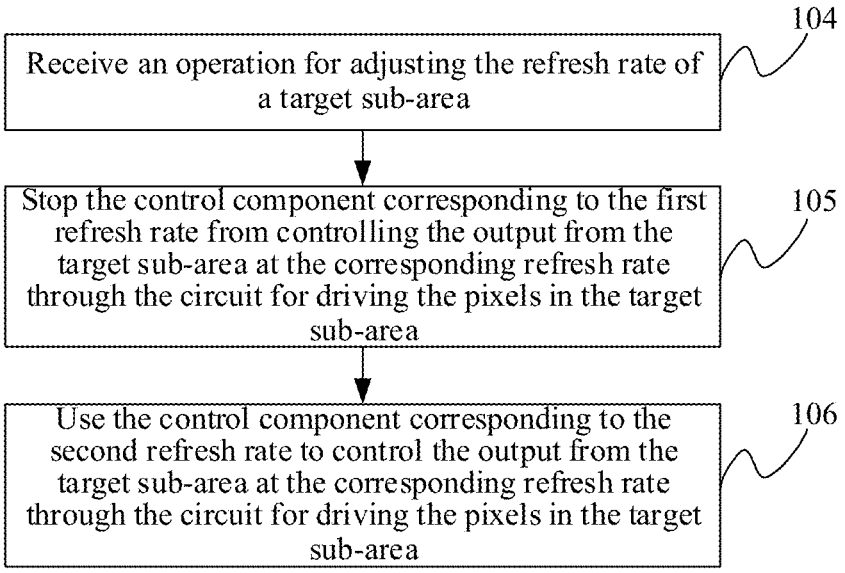
FIG. 11 is a flowchart illustrating another part of an exemplary display control method according to some embodiments of the present disclosure.

As such, when each control component controls the output from the corresponding display sub-area at the corresponding refresh rate, the refresh rate may be adjusted for each display sub-area according to operations by the user. As shown in FIG. 11, an adjustment process may include the following steps.

At step 104, an operation for adjusting the refresh rate of a target sub-area is received.

The target sub-area at least includes a portion of the display sub-area. The operation for adjusting the refresh rate is used to adjust the refresh rate of the target sub-area from a first refresh rate to a second refresh rate.

In some embodiments, the operation for adjusting the refresh rate may be an operation for the user to increase or decrease the refresh rate of a display sub-area. In this case, the target sub-area is the entire display sub-area. The second refresh rate of the target sub-area is the refresh parameter in the operation for adjusting the refresh rate. In some other embodiments, the operation for adjusting the refresh rate may be an operation for the user to adjust the division of the display area. In this case, the target sub-area changes from one display sub-area to a portion of another display sub-area. The first refresh rate of the target sub-area is the refresh rate of the original display sub-area to which the target sub-area belongs. The second refresh rate of the target sub-area is the refresh rate of the current display sub-area to which the target sub-area belongs.

At step 105, the control component corresponding to the first refresh rate is stopped from controlling the output from the target sub-area at the corresponding refresh rate through the circuit for driving the pixels in the target sub-area.

In some embodiments, the circuit for driving the pixels in the target sub-area is turned off at the control component corresponding to the first refresh rate, such that the control component corresponding to the first refresh rate stops controlling the output from the target sub-area at the corresponding refresh rate through the circuit for driving the pixels in the target sub-area. At this time, a current and a voltage at the circuit of the control component corresponding to the first refresh rate for driving the pixels in the target sub-area are both 0.

At step 106, the control component corresponding to the second refresh rate is used to control the output from the target sub-area at the corresponding refresh rate through the circuit for driving the pixels in the target sub-area.

In some embodiments, the circuit for driving the pixels in the target sub-area is turned on at the control component corresponding to the second refresh rate, for example, a current or a voltage is applied to the driving circuit, such that the control component corresponding to the second refresh rate controls the output from the target sub-area at the corresponding refresh rate through the circuit for driving the pixels in the target sub-area.

In some embodiments, when the operation for adjusting the refresh rate is the operation for the user to increase or decrease the refresh rate of the entire display sub-area, the control component corresponding to the first refresh rate is the original control component corresponding to the display sub-area. When the original control component is able to support the second refresh rate, the control component corresponding to the second refresh rate is the original control component. When the original control component is unable to support the second refresh rate, another control component of the display device is determined, such that the circuit for driving the pixels in the target sub-area is turned off for the control component corresponding to the first refresh rate, and the circuit for driving the pixels in the target sub-area is turned on for the control component corresponding to the second refresh rate.

Figure 12:
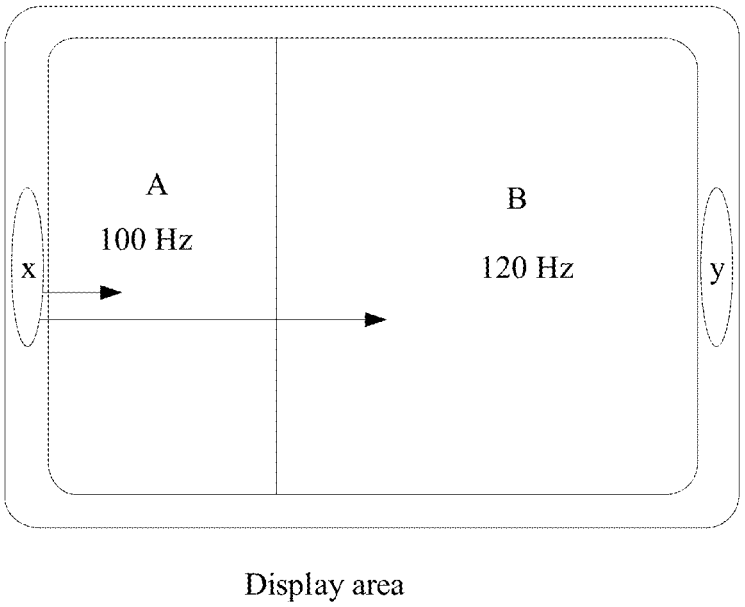
FIGS. 12-14 are schematic diagrams illustrating more exemplary application scenarios respectively according to some embodiments of the present disclosure.

Further, the circuit for driving the pixels in other sub-areas is turned on for the control component corresponding to the first refresh rate, and the circuit for driving the pixels in other sub-areas remains turned on for the control component corresponding to the second refresh rate. In other words, the control components correspond to the display sub-areas of the display area are switched to control the outputs from the corresponding display sub-areas at the required refresh rates. For example, as shown in FIG. 12, when the refresh rate of the display sub-area needs to be 120 Hz, the control component x corresponds to the display sub-area B. The display sub-area B is controlled by the control component x to achieve the 120 Hz refresh rate.

Figure 13:
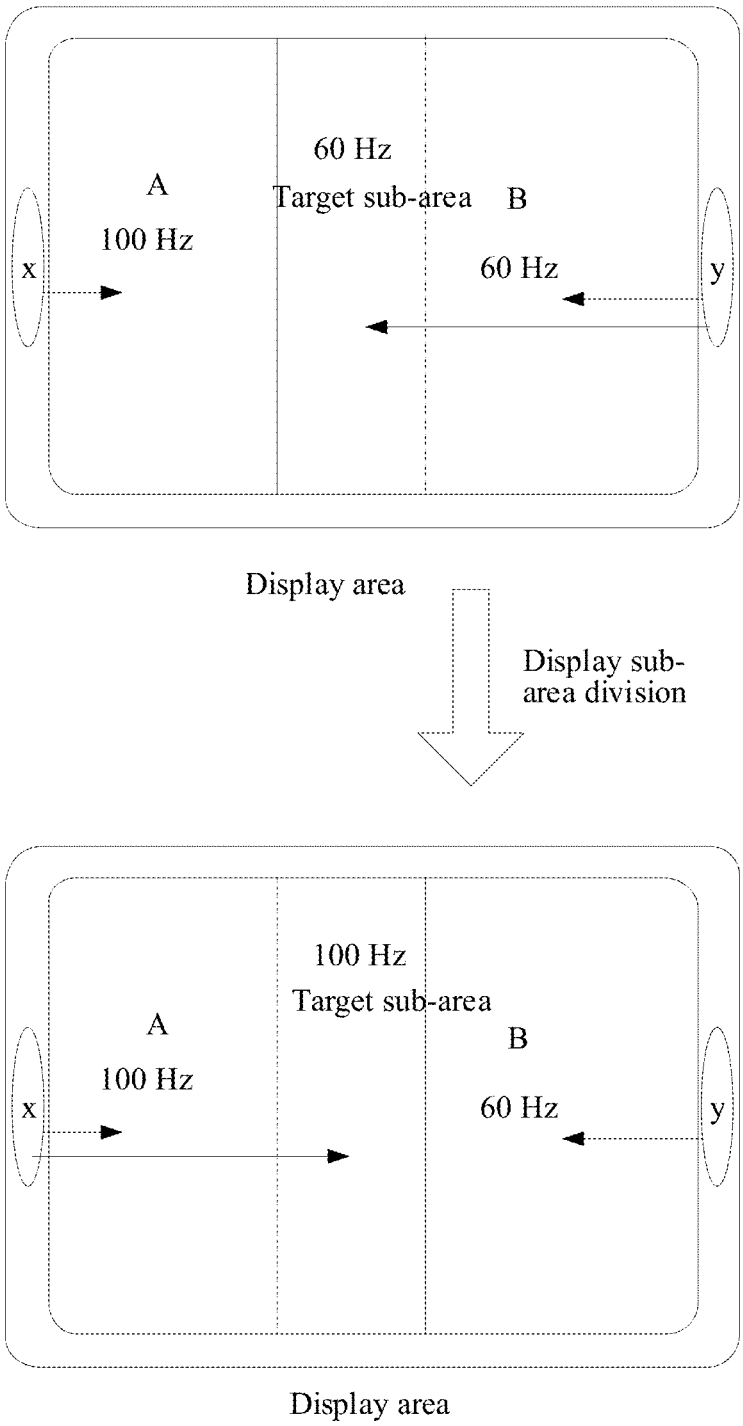

In some embodiments, when the operation for adjusting the refresh rate is the operation for the user to adjust the division of the display area, the control component corresponding to the adjusted target sub-area is adjusted, and the original control component corresponding to the target sub-area is replaced by the control component corresponding to the second refresh rate, such that the control components respectively control the outputs from the corresponding display sub-areas at the required refresh rates. For example, as shown in FIG. 13, the target sub-area changes from the display sub-area B to the display sub-area A. At this time, the control component y no longer controls the output from the target sub-area at the 60 Hz refresh rate through the driving circuit thereof. Instead, the control component x controls the output from the target sub-area at the 100 Hz refresh rate through the driving circuit thereof. No change occurs in other display sub-areas.

Figure 14:
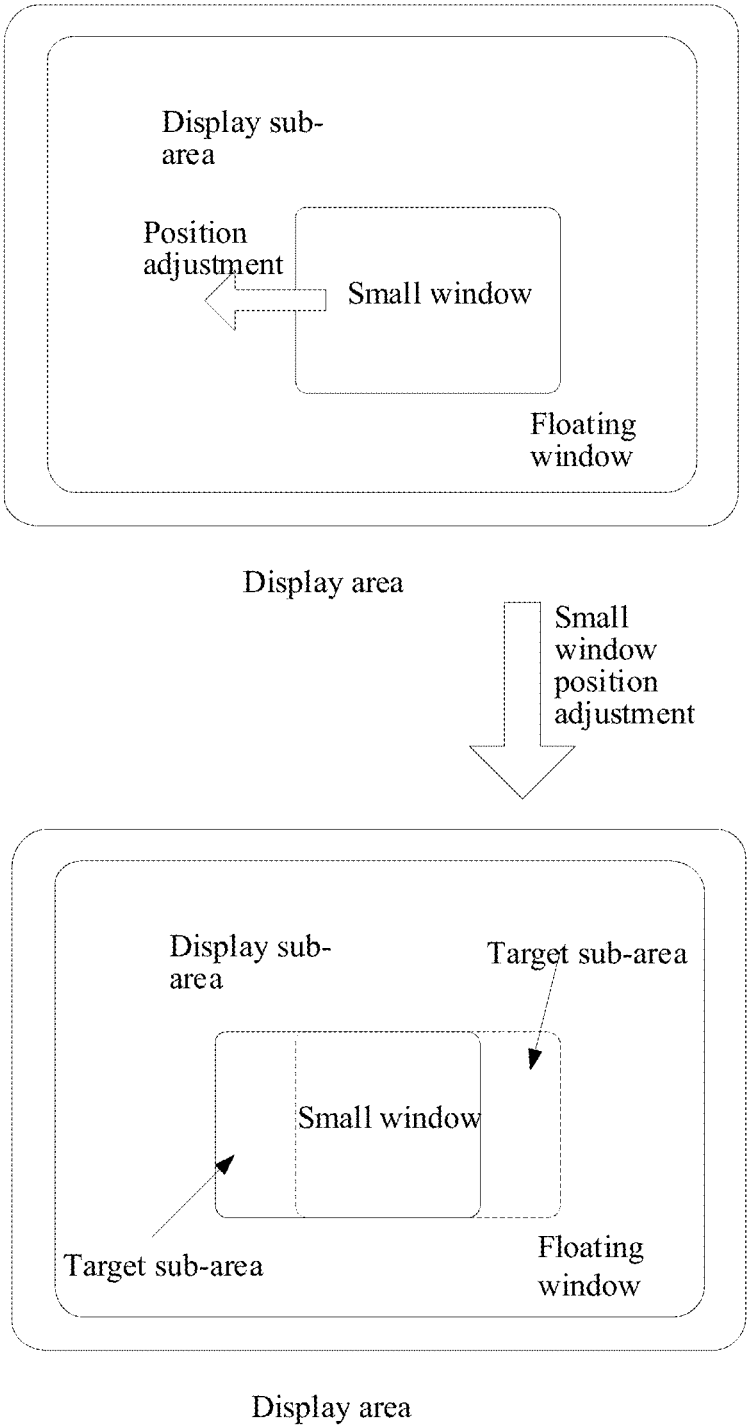

In some embodiments, the operation for the user to adjust the division of the display sub-areas in the display area includes: an operation for the user to adjust the division of the display sub-areas that are adjacent but are not overlapping, such that scopes of the display sub-areas involving the target sub-area are redrawn accordingly. As shown in FIG. 13, the scopes of the display sub-areas are redrawn. As such, after the refresh rate of the target sub-area in the redrawn display sub-area is adjusted, the scopes of the display sub-areas corresponding to the refresh rates change accordingly. In some other embodiments, the operation for the user to adjust the division of the display area may also be an operation for the user to adjust a position of a small window floating displayed in the display area, such that the scopes of the display sub-area excluding the small window are redrawn in the display area. The scope of the small window is also redrawn, as shown in FIG. 14. As such, after the refresh rate of the target sub-area in the redrawn display sub-area is adjusted, the scopes of the display sub-areas corresponding to the refresh rates change accordingly.

Figure 15:
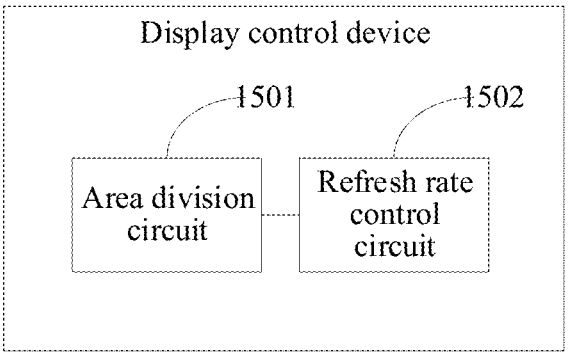
FIG. 15 is a structural diagram illustrating an exemplary display control device according to some embodiments of the present disclosure.

FIG. 15 is a structural diagram illustrating an exemplary display control device according to some embodiments of the present disclosure. The display control device may be configured in a display device having a display area, such as a display screen or a mobile phone screen. The technical solution in the embodiments of the present disclosure is used to solve the technical problem that the high refresh rate of the entire display screen causes the high power consumption of the display screen.

In some embodiments, the device includes an area division circuit 1501 and a refresh rate control circuit 1502. The area division circuit 1501 is configured to divide a display area of the display device into multiple display sub-areas. The refresh rate control circuit 1502 is configured to respectively control outputs from different display sub-areas at different refresh rates after the display area of the display device is divided into multiple display sub-areas. The refresh rates of different display sub-areas may be the same or different.

In some embodiments, the display control device monitors whether the display area is divided into multiple display sub-areas, and controls the outputs from different display sub-areas at different refresh rates. Thus, the high consumption caused by the high refresh rate of the entire display area is avoided, and the power consumption of the display device is reduced.

In one embodiment, the refresh rate of each display sub-area is related to a configuration operation received for the corresponding display sub-area. In this case, the configuration operation is a configuration operation performed by the user of the display device for the corresponding display sub-area. The configuration operation includes a refresh parameter, such that the refresh rate of the corresponding display sub-area is updated to correspond to the refresh parameter.

In one embodiment, the refresh rate of each display sub-area is related to content displayed in the display sub-area. In other words, the refresh rate of the display sub-area may change due to a change of the content displayed in the display sub-area. The displayed content includes a content type, such that the refresh rate of the corresponding display sub-area corresponds to the content type.

In one embodiment, the refresh rate of each display sub-area is related to display brightness of the display sub-area. When the display brightness is lower than or equal to a brightness threshold, the refresh rate of the display sub-area is smaller than or equal to a refresh rate threshold.

In one embodiment, the display device includes multiple control components. Each control component corresponds to the display area of the display device. Each control component includes a circuit for driving each pixel in the display area.

In some embodiments, the refresh rate control circuit 1502 is configured to: determine a control component for each display sub-area according to the corresponding refresh rate of the display sub-area, where the refresh rate supported by the control component corresponding to each display sub-area is related to the refresh rate of the corresponding display sub-area, and control the output from the display sub-area at the corresponding refresh rate through the circuit for driving pixels in the corresponding display sub-area.

In some embodiments, the refresh rate control circuit 1502 is further configured to: receive an operation for adjusting the refresh rate of the target sub-area, where the target sub-area at least includes a portion of the display sub-area, and the operation for adjusting the refresh rate is used to adjust the refresh rate of the target sub-area from a first refresh rate to a second refresh rate; stop the control component corresponding to the first refresh rate from controlling the output from the target sub-area at the corresponding refresh rate through the circuit for driving the pixels in the target sub-area; and use the control component corresponding to the second refresh rate to control the output from the target sub-area at the corresponding refresh rate through the circuit for driving the pixels in the target sub-area.

In some embodiments, the circuit for driving the pixels in the target sub-area is turned off at the control component corresponding to the first refresh rate, such that the control component corresponding to the first refresh rate stops controlling the output from the target sub-area at the corresponding refresh rate through the circuit for driving the pixels in the target sub-area.

In some embodiments, the circuit for driving the pixels in the target sub-area is turned on at the control component corresponding to the second refresh rate, such that the control component corresponding to the second refresh rate controls the output from the target sub-area at the corresponding refresh rate through the circuit for driving the pixels in the target sub-area.

It should be noted that, for specific implementation of each circuit in the embodiments of the present disclosure, reference may be made to the corresponding description in the foregoing specification, which will not be described in detail herein.

Figure 16:
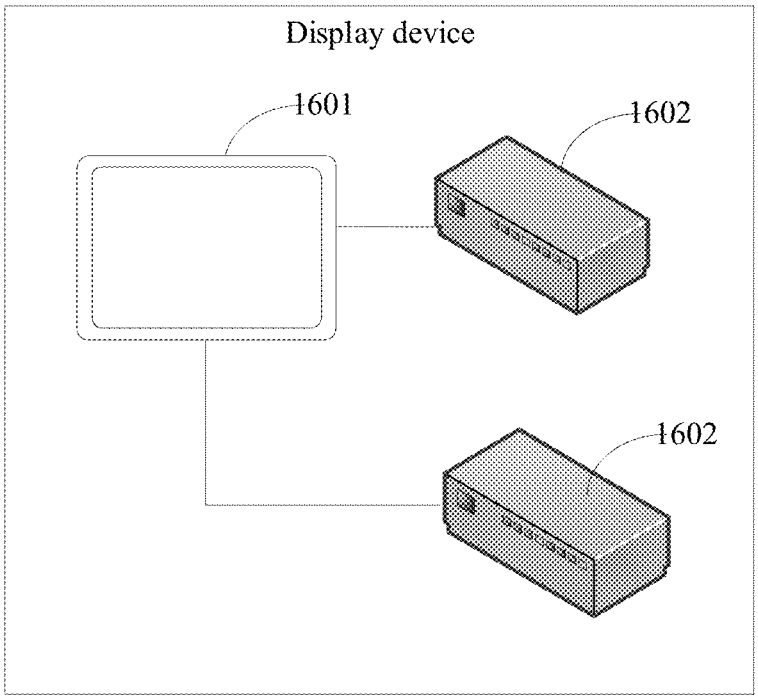
FIG. 16 is a structural diagram illustrating another exemplary display control device according to some embodiments of the present disclosure.

FIG. 16 is a structural diagram illustrating another exemplary display control device according to some embodiments of the present disclosure. The display device may be a display device of a mobile phone, a tablet computer, a laptop computer, or desktop computer. The technical solution in the embodiments of the present disclosure is used to solve the technical problem that the high refresh rate of the entire display screen causes the high power consumption of the display screen.

In some embodiments, the display device includes a display component 1601 having a display area, such as a touch-control display screen, and multiple control components 1602, such as control IC chips or control cores of a control IC chip. Each control component 1602 corresponds to the display area of the display device. Each control component includes a circuit for driving each pixel in the display area. After the display area is divided into multiple display sub-areas, the control component 1602 corresponding to each display sub-area is used to control the output from the corresponding display sub-area through the circuit for driving the pixels in the corresponding display sub-area. The refresh rate supported by the control component corresponding to each display sub-area is related to the refresh rate of the corresponding display sub-area.

In the embodiments of the present disclosure, through the multiple control components configured in the display device, the display device respectively controls the outputs from different display sub-areas at different refresh rates by the corresponding control component after the display area of the display device is monitored to be divided into multiple display sub-areas. Thus, the high consumption caused by the high refresh rate of the entire display area is avoided, and the power consumption of the display device is reduced.

For example, the display device is a display screen of a mobile phone. The technical solution of the embodiments of the present disclosure is described in detail herein.

First, with the increasing development of mobile phones and display screens, high refresh rate display screens are becoming more and more popular among users. The screen refresh rate of mobile phone products has gradually increased from 60 Hz to 90 Hz, 120 Hz, or even 144 Hz. But high refresh rate brings several problems. If the brightness is too low, that is, the charging time is insufficient, there will be mura (uneven display) in low-brightness and low-grayscale display interface. Turning on the high refresh rate for an extended time period causes the screen power consumption to increase. The user selects the global refresh rate through a configuration interface, or the system adapts to a fixed application with a high refresh rate. However, neither can independently select a suitable refresh rate scene in real time.

In view of the above-mentioned problems, the present disclosure provides the technical solution that can achieve the high refresh rate locally in the display sub-areas and the technical solution for adjusting the refresh rate in a low-brightness and low-grayscale mode. After adopting the technical solution of the present disclosure, local high refresh rate can be achieved. Further, application-based screen division for large display screens can distinguish different application scenes, select an appropriate refresh rate, and make the display unevenness and Mura phenomenon imperceptible to users.

Figure 17:
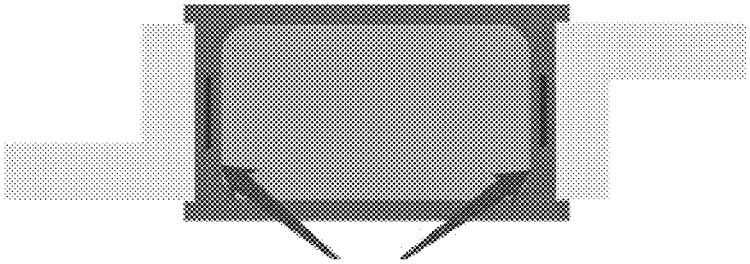
FIGS. 17-20 are schematic diagrams illustrating exemplary application scenarios for a mobile phone display screen according to some embodiments of the present disclosure.
Figure 18:
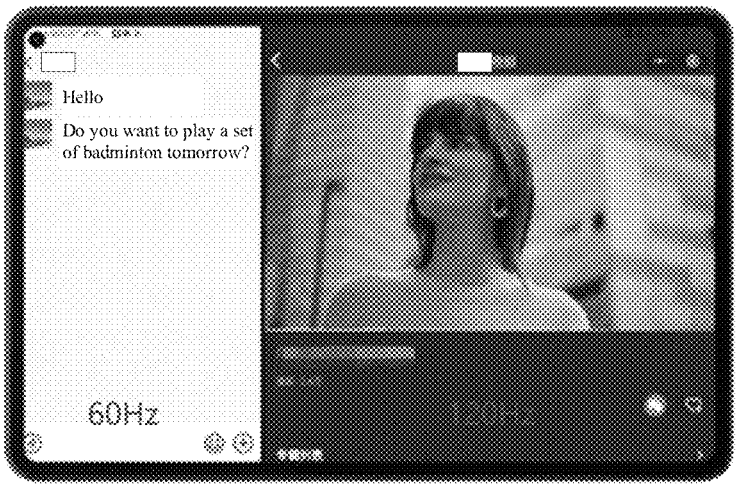

In one embodiment, the technical solution can achieve the high refresh rate of the display sub-areas locally. The technical solution is implemented by two display driver ICs (DDICs): IC-A and IC-B. IC-B supports 60 Hz refresh rate, and IC-A supports 120 Hz refresh rate. Both IC-A and IC-B support full-screen global settings. As shown in FIG. 17, IC-A and IC-B are disposed at both sides of the display screen. In a normal mode, that is, the display screen is undivided, through the user refresh rate setting, either IC-A or IC-B is turned on. The idle one of IC-A and IC-B enters a dormant state. In a screen division mode, after the display area is divided into two display sub-areas on the left and right sides, IC-A and IC-B operate at the same time. The user can select the refresh rate corresponding to each display sub-area. The display sub-area having the high refresh rate is driven by IC-A, and the display sub-area having the low refresh rate is driven by IC-B. As shown in FIG. 18, different refresh rates are configured for the display sub-areas. The display sub-areas for contents such as chat applications, short message editors, and readers are driven by IC-B to achieve the 60 Hz refresh rate, while the display sub-areas for contents such as video playback, news web browsing, game interfaces are driven by IC-A to achieve the 120 Hz refresh rate.

Figure 19:
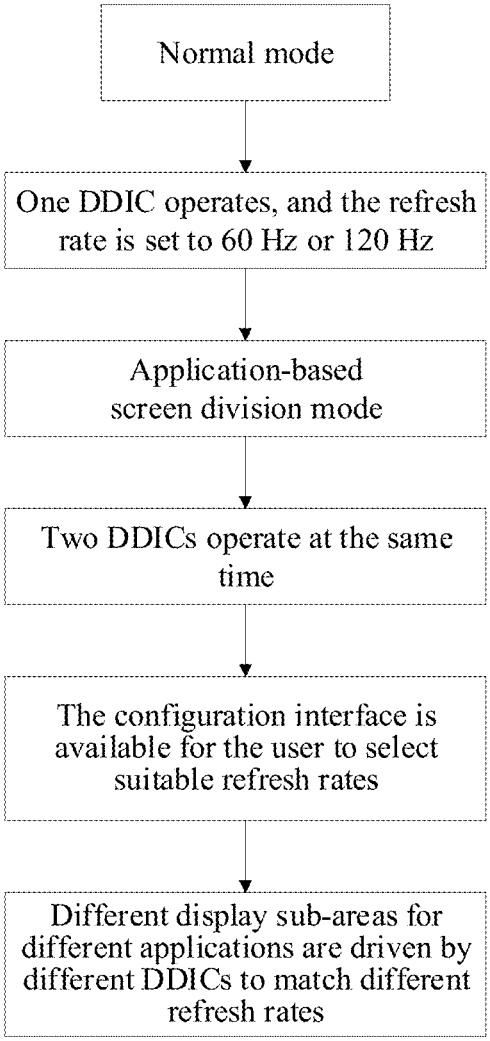

FIG. 19 illustrates a flowchart. In the normal mode, only one DDIC operates, and the refresh rate is set to 60 Hz or 120 Hz. After the application-based screen division mode is applied, the two DDICs operate at the same time, and the configuration interface is available for the user to select suitable refresh rates. Then, different display sub-areas for different applications are driven by different DDICs to match different refresh rates.

In addition, the technical solution for adjusting the refresh rate in the low-brightness and low-grayscale mode may be implemented in the following.

In one embodiment, in a pre-production phase, brightness samples are collected and acceptable low-brightness limit, such as 5 nit, is defined to ensure that uniformity of compensated display can satisfy user's operation conditions. Scene brightness is checked each time the display screen displays an image. If the scene brightness is lower than the acceptable low-brightness limit, the scene brightness is forced to be adjusted and fixed at 5 nit, which is the lowest acceptable brightness.

In another embodiment, in the pre-production phase, the brightness samples are collected and the acceptable low-brightness limit is defined to match different refresh rates. For example, the 60 Hz refresh rate provides a normal display effect when the scene brightness is smaller than or equal to 5 nit, and the 120 Hz refresh rate provides the normal display effect when the scene brightness is greater than 5 nit. The display screen self-monitors the scene brightness in real time. When the scene brightness is lower than the acceptable low-brightness limit, the 60 Hz refresh rate is enforced. Otherwise, the refresh rate remains unchanged.

Figure 20:
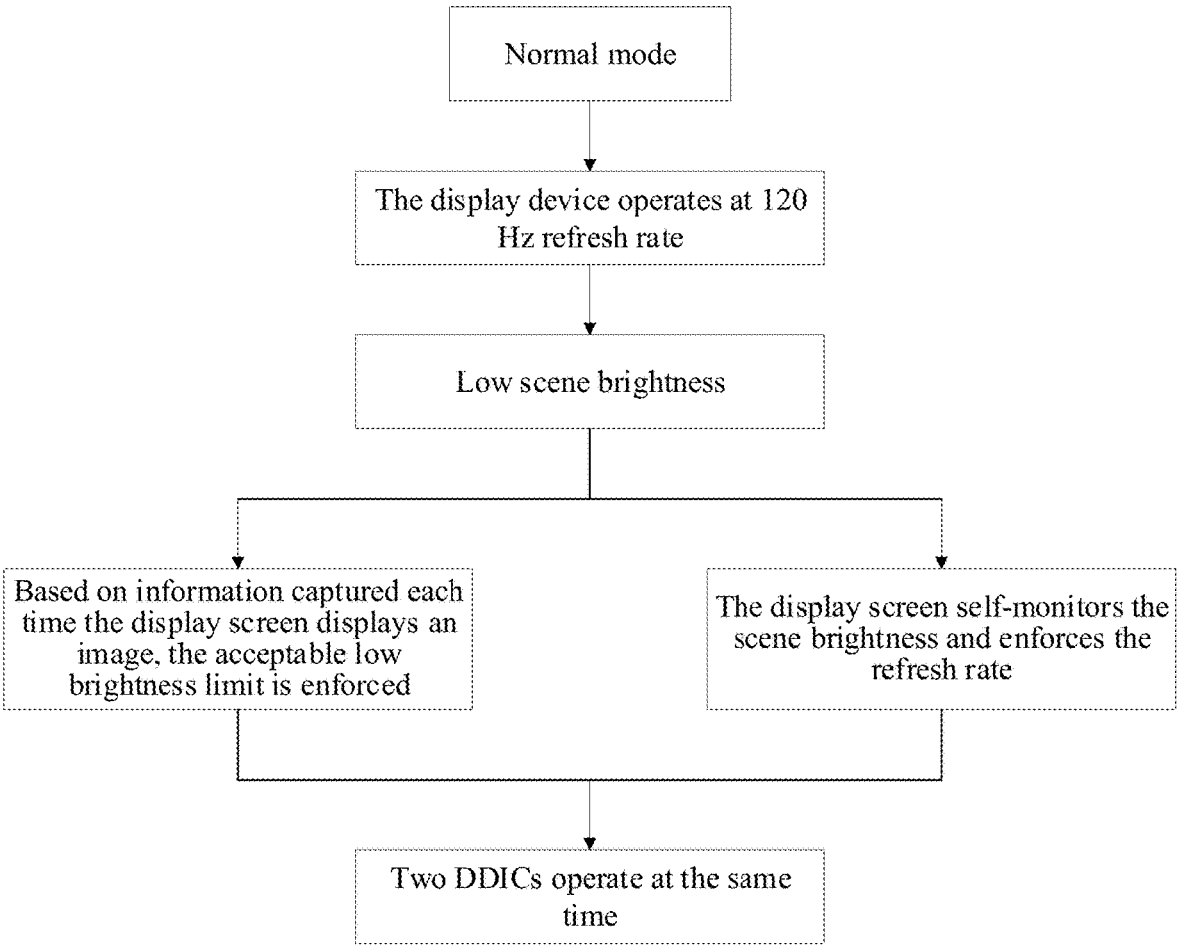

In the flowchart shown in FIG. 20, in the normal mode, the display screen operates at the 120 Hz refresh rate. In the low-brightness scene, based on information captured each time the display screen displays an image, the acceptable low brightness limit is enforced. Alternatively, the display screen self-monitors the scene brightness and enforces the refresh rate. As a result, no display unevenness is noticed by the user, and the user's experience of using the display screen is improved.

It can be seen from the above solution that, in the display control method and display device provided by the present disclosure, by monitoring whether the display area is divided into multiple display sub-areas, the outputs from different display sub-areas can be controlled at different refresh rates. Thus, the high power consumption caused by maintaining a high refresh rate for the entire display area is avoided, thereby reducing the power consumption of the display device.

Various embodiments of the present disclosure are described in a progressive manner, and each embodiment focuses on the differences from other embodiments, and the same or similar parts between the various embodiments can be referred to each other. For the device disclosed in the embodiment, since it corresponds to the method disclosed in the embodiments, the description is relatively simple, and the relevant parts can refer to the description of the corresponding method parts.

Those skilled in the art can further realize that the units and algorithm steps of the examples described in the embodiments disclosed in the specification can be implemented by electronic hardware, computer software, or a combination of both. To clearly illustrate interchangeabilities of hardware and software, the structures and steps of each example have been generally described in the specification in accordance with the functions. Whether these functions are implemented by hardware or software depends on the specific application and design constraints of the technical solution. Those skilled in the art can use different methods for each specific application to implement the described functions, but such implementation should not be considered beyond the scope of this application.

The steps of the method or algorithm described in the embodiments disclosed in the specification can be directly implemented by hardware, a software module executed by a processor, or a combination thereof. The software module can be stored in random access memory (RAM), internal memory, read-only memory (ROM), electrically programmable ROM, electrically erasable programmable ROM, registers, hard disks, removable disks, CD-ROMs, or any other storage media known in the technical field.

The above description of the disclosed embodiments enables those skilled in the art to implement or use this application. Various modifications to these embodiments will be obvious to those skilled in the art, and the general principles defined herein can be implemented in other embodiments without departing from the spirit or scope of the present application. Therefore, this application will not be limited to the embodiments shown in the specification, but should conform to the broadest scope consistent with the principles and novelties disclosed in the specification.

What is claimed is:

1. A display control method, comprising:

providing at least two display driver ICs (DDICs), with at least two of the DDICs disposed at each opposing side of a display screen having a display area of a display device, and each of the DDICs having a corresponding circuit for driving each pixel in the display area;

in a normal mode whereby the display area is undivided, turning on one of the DDICs, serving fully the display area and leaving at least one of the DDICs idle; and in a division mode whereby the display area of the display device being divided into multiple display sub-areas, turning on at least two of the DDICs, each serving one of the multiple display sub-areas and controlling outputs from the multiple display sub-areas at corresponding refresh rates.

2. The method according to claim 1, wherein:

the refresh rate of each display sub-area is related to a configuration operation received for the corresponding display sub-area, wherein the configuration operation includes a refresh parameter, such that the refresh rate of the corresponding display sub-area corresponds to the refresh parameter.

3. The method according to claim 1, wherein:

the refresh rate of each display sub-area is related to content displayed in the corresponding display sub-area, wherein the displayed content includes a content type, such that the refresh rate of the corresponding display sub-area corresponds to the content type.

4. The method according to claim 1, wherein:

the refresh rate of each display sub-area is related to display brightness of the corresponding display sub-area.

5. The method according to claim 4, wherein:

when the display brightness is lower than or equal to a brightness threshold, the refresh rate of the display sub-area is smaller than or equal to a refresh rate threshold.

6. The method according to claim 1, further including:

receiving an operation for adjusting the refresh rate of a target sub-area, wherein the target sub-area at least includes a portion of the display sub-area, and the operation for adjusting the refresh rate is used to adjust the refresh rate of the target sub-area from a first refresh rate to a second refresh rate;

stopping the corresponding DDIC corresponding to the first refresh rate from controlling the output from the target sub-area at the corresponding refresh rate through the circuit for driving the pixels in the target sub-area; and using the corresponding DDIC corresponding to the second refresh rate to control the output from the target sub-area at the corresponding refresh rate through the circuit for driving the pixels in the target sub-area.

7. The method according to claim 6, wherein stopping the corresponding DDIC corresponding to the first refresh rate from controlling the output from the target sub-area at the corresponding refresh rate through the circuit for driving the pixels in the target sub-area includes:

turning off the circuit for driving the pixels in the target sub-area at the corresponding DDIC corresponding to the first refresh rate.

8. The method according to claim 6, wherein using the corresponding DDIC for the second refresh rate to control the output from the target sub-area at the corresponding refresh rate through the circuit for driving the pixels in the target sub-area includes:

turning on the circuit for driving the pixels in the target sub-area at the corresponding DDIC corresponding to the second refresh rate.

9. A display device, comprising:

a display component having a display screen having a display area; and at least two display driver ICs (DDICs), with at least two of the DDICs disposed at each opposing side of the display screen, and each of the DDICs having a corresponding circuit for driving each pixel in the display area;

wherein in a normal mode whereby the display area is undivided, one of the DDICs in configured to be turned on, serving fully the display area and leaving at least one of the DDICs idle; and in a division mode whereby the display area of the display device being divided into multiple display sub-areas, the at least two of the DDICs are configured to be turned on, each serving one of the multiple display sub-areas and controlling an output from each display sub-area at a refresh rate of the corresponding display sub-area through the corresponding circuit for driving each pixel in the corresponding display sub-area, wherein the refresh rate supported by the corresponding DDIC corresponding to each display sub-area is related to the refresh rate of the corresponding display sub-area.

10. The device according to claim 9, wherein:

the refresh rate of each display sub-area is related to a configuration operation received for the corresponding display sub-area, wherein the configuration operation includes a refresh parameter, such that the refresh rate of the corresponding display sub-area corresponds to the refresh parameter.

11. The device according to claim 9, wherein:

the refresh rate of each display sub-area is related to content displayed in the corresponding display sub-area, wherein the displayed content includes a content type, such that the refresh rate of the corresponding display sub-area corresponds to the content type.

12. The device according to claim 9, wherein:

the refresh rate of each display sub-area is related to display brightness of the corresponding display sub-area.

13. The device according to claim 12, wherein:

when the display brightness is lower than or equal to a brightness threshold, the refresh rate of the display sub-area is smaller than or equal to a refresh rate threshold.

14. The device according to claim 9, wherein controlling the output from each display sub-area at the refresh rate of the corresponding display sub-area through the circuit for driving each pixel in the corresponding display sub-area further includes:

receiving an operation for adjusting the refresh rate of a target sub-area, wherein the target sub-area at least includes a portion of the display sub-area, and the operation for adjusting the refresh rate is used to adjust the refresh rate of the target sub-area from a first refresh rate to a second refresh rate;

stopping the corresponding DDIC corresponding to the first refresh rate from controlling the output from the target sub-area at the corresponding refresh rate through the circuit for driving the pixels in the target sub-area; and using the corresponding DDIC corresponding to the second refresh rate to control the output from the target sub-area at the corresponding refresh rate through the circuit for driving the pixels in the target sub-area.

15. The device according to claim 14, wherein stopping the corresponding DDIC corresponding to the first refresh rate from controlling the output from the target sub-area at the corresponding refresh rate through the circuit for driving the pixels in the target sub-area includes:

turning off the circuit for driving the pixels in the target sub-area at the corresponding DDIC corresponding to the first refresh rate, such that the corresponding DDIC corresponding to the first refresh rate stops controlling the output from the target sub-area at the corresponding refresh rate through the circuit for driving the pixels in the target sub-area.

16. The device according to claim 14, wherein using the corresponding DDIC for the second refresh rate to control the output from the target sub-area at the corresponding refresh rate through the circuit for driving the pixels in the target sub-area includes:

turning on the circuit for driving the pixels in the target sub-area at the corresponding DDIC corresponding to the second refresh rate, such that the corresponding DDIC corresponding to the second refresh rate controls the output from the target sub-area at the corresponding refresh rate through the circuit for driving the pixels in the target sub-area.

* * * * *